US008715079B1

(12) United States Patent
Loose

(10) Patent No.: US 8,715,079 B1
(45) Date of Patent: May 6, 2014

(54) CURVED FLOATING VIRTUAL DISPLAY

(75) Inventor: Timothy C. Loose, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/447,213

(22) Filed: Apr. 14, 2012

Related U.S. Application Data

(60) Provisional application No. 61/475,796, filed on Apr. 15, 2011.

(51) Int. Cl.
*A63F 9/24* (2006.01)

(52) U.S. Cl.
USPC ..... 463/34; 463/30; 463/31; 463/32; 463/33

(58) Field of Classification Search
USPC ..... 463/30–34
See application file for complete search history.

(56) References Cited

U.S. PATENT DOCUMENTS

| | | | | |
|---|---|---|---|---|
| 3,647,284 | A | 3/1972 | Elings et al. | |
| 4,653,875 | A * | 3/1987 | Hines | 359/485.04 |
| 4,802,750 | A | 2/1989 | Welck | |
| 5,311,357 | A | 5/1994 | Summer et al. | |
| 5,669,685 | A * | 9/1997 | Kotani et al. | 353/28 |
| 5,842,060 | A * | 11/1998 | White et al. | 396/155 |
| 6,517,437 | B1 * | 2/2003 | Wells et al. | 463/30 |
| 6,568,818 | B2 | 5/2003 | Holden et al. | |
| 6,808,268 | B2 | 10/2004 | Vrachan et al. | |
| 7,166,029 | B2 * | 1/2007 | Enzminger | 463/20 |
| 7,517,090 | B2 | 4/2009 | Vrachan et al. | |
| 7,562,983 | B2 | 7/2009 | Kim et al. | |
| 7,568,803 | B2 | 8/2009 | Vrachan et al. | |
| 7,614,749 | B2 | 11/2009 | Vrachan et al. | |
| 2007/0242227 | A1 | 10/2007 | Nikitin | |
| 2008/0049151 | A1 | 2/2008 | Vrachan et al. | |
| 2009/0069070 | A1 * | 3/2009 | Crowder et al. | 463/20 |

* cited by examiner

*Primary Examiner* — Steve Rowland
(74) *Attorney, Agent, or Firm* — DeLizio Gilliam, PLLC

(57) ABSTRACT

An apparatus comprises a video device configured to output a video image. The apparatus comprises a curved beam splitter positioned in optical alignment with the video device, wherein a convex surface of the curved beam splitter is configured to receive the video image being output from the video device. The apparatus also includes a rotationally symmetrical mirror positioned in optical alignment with the curved beam splitter such that a part of the video image from the video device is directed to the rotationally symmetrical mirror, wherein the part of the video image reflected off the rotationally symmetrical mirror produces a curved aerial image.

22 Claims, 11 Drawing Sheets

CURVED FLOATING VIRTUAL DISPLAY

RELATED APPLICATIONS

This application claims the priority benefit of U.S. Provisional Application Ser. No. 61/475,796 filed Apr. 15, 2011.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

FIELD

Embodiments of the inventive subject matter relate generally to display technology, and more particularly to curved floating virtual displays.

BACKGROUND

Conventional projection systems that display aerial images are used in a number of different applications. To illustrate, these conventional projection systems can be used to provide aerial images of a specific product for advertising or customer attraction in brick-and-mortar retail establishments. For example, these conventional projection systems can display a floating image of a shoe, a food, etc. drink product that the retail establishment or manufacturer is marketing.

BRIEF DESCRIPTION OF THE FIGURES

Embodiments of the invention are illustrated in the Figures of the accompanying drawings in which.

DESCRIPTION OF THE EMBODIMENTS

Figure 1:
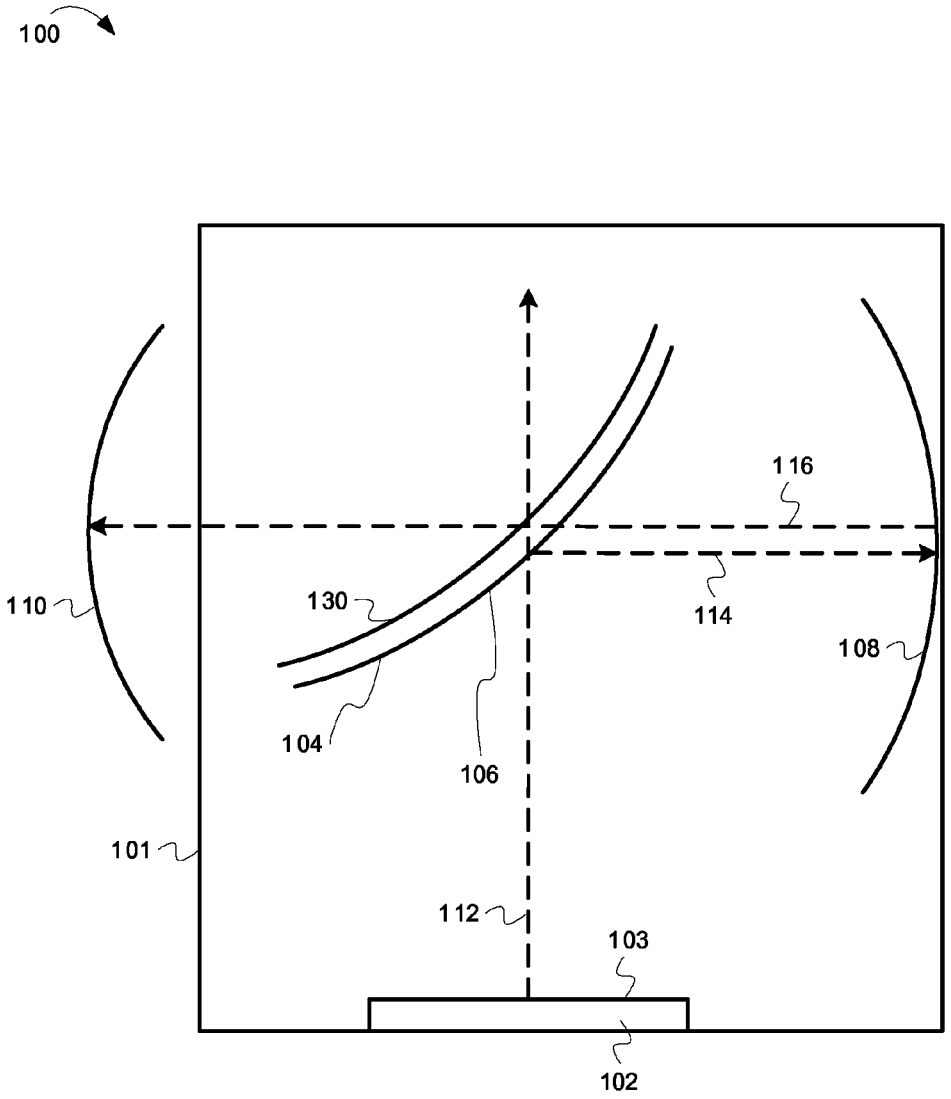
FIG. 1 depicts a side view of a display system having a curved beam splitter for displaying a curved floating virtual display, according to some example embodiments.

This description of the embodiments is divided into six sections. The first section provides an introduction to some example embodiments, while the second section describes example display systems. The third section describes example operations performed by some example embodiments. The fourth section describes a wagering game machine architecture. The fifth section describes an example wagering game machine, and the sixth section presents some general comments.

Introduction

This section provides an introduction to some example embodiments. Some example embodiments provide a curved floating virtual display. While examples described herein are for a curved floating virtual display as part of a visual output of a wagering game machine (e.g., video reels that provide a result of a wagering game machine), some example embodiments can be used to provide a curved floating virtual display for any other applications (e.g., advertisements).

Some example embodiments are incorporated into a wagering game machine to simulate curved mechanical reels with a variable display technology. In contrast to conventional aerial display systems, some example embodiments incorporate a curved component to produce a curved aerial image. The curved aerial image can be produced external or internal to a housing that houses the components that produce the curved aerial image. An example application for the curved aerial image can be the visual output for a wagering game machine (e.g., a slot machine). In particular, the curved aerial image can comprise video of reels that represent a visual result of the wagering game machine.

Accordingly, some example embodiments alter an optical path of an aerial image such that the image is no longer produced as a flat image. In particular, some example embodiments (in contrast to conventional aerial image display systems) use non-symmetrical optics to warp a flat image from a display to create a curved real image at a display viewing location. Thus, the curved aerial images of spinning reels have the same appearance as projected mechanical reels without the need for multiple projectors, screens, etc. Such embodiments allow for downloadable reels and reel strip animations with a curved surface. Also, some example embodiments use a flat display device to produce a curved resultant image. The use of flat display devices can be better than the use of curved display devices to produce a curved resultant image because flat display devices can be more readily available and more cost effective in comparison to curved display devices.

The components within the housing to produce the curved aerial image can include a display device, a beam splitter, a rotationally symmetrical mirror and one or more additional mirrors (as further described below). In some example embodiments, the curved component that causes the aerial image to be curved comprises a curved beam splitter that partially reflects an image output received from a video device (e.g., a Liquid Crystal Display (LCD) panel, Light Emitting Diode (LED) panel, plasma display, Cathode Ray Tube (CRT), Thin Film Transistor (TFT) display, etc.). This partial reflection from the curved beam splitter can be transmitted to a surface of the rotationally symmetrical mirror. The reflection from the surface of the rotationally symmetrical mirror can produce the curved aerial image (either within or outside the housing).

In some example embodiments, instead of having a curved beam splitter, the rotationally symmetrical mirror can be altered to produce the curved aerial image. For example instead of using a spherical rotationally symmetrical mirror, the rotationally symmetrical mirror can be elliptical. Accordingly, the rotationally symmetrical mirror has a different radius of curvature vertically and laterally to produce the curved aerial image. Such a configuration would bend the curved aerial image at different vertical locations.

In some example embodiments, instead of having a curved beam splitter or the altered rotationally symmetrical mirror, an additional curved mirror can be added in the optical path at one or more locations between the video device, the beam splitter, the rotationally symmetrical mirror and the location where the curved aerial image is produced. For example, this additional curved mirror can be positioned between the video device and the beam splitter.

These example embodiments can also be combined. For example, the housing can comprise both a curved beam splitter and a rotationally symmetrical mirror that has been altered. In another example, the housing can comprise a curved beam splitter and an additional curved mirror in one or more of the optical paths.

Some example embodiments include a transmissive display panel that a curved aerial image passes through and is produced in front of a display surface of the transmissive display panel. For example, the curved aerial image can provide variable reel symbols, wherein the transmissive display panel provides a background of traditional reels of a wagering game machine. Accordingly, two separate images are created (the curved aerial image and the image output from the transmissive display panel) to form a transmissive reel presentation.

Example Display Systems

This section describes example display systems for providing a curved floating virtual display, according to some example embodiments. This section will describe FIGS. 1-8. FIGS. 1-7 depict different example display systems used to produce a curved aerial image. FIG. 8 depicts an example curved aerial image. While shown in different figures, some or parts of the example display systems in FIGS. 1-7 can be combined in different combinations (as further described below).

Figure 10:
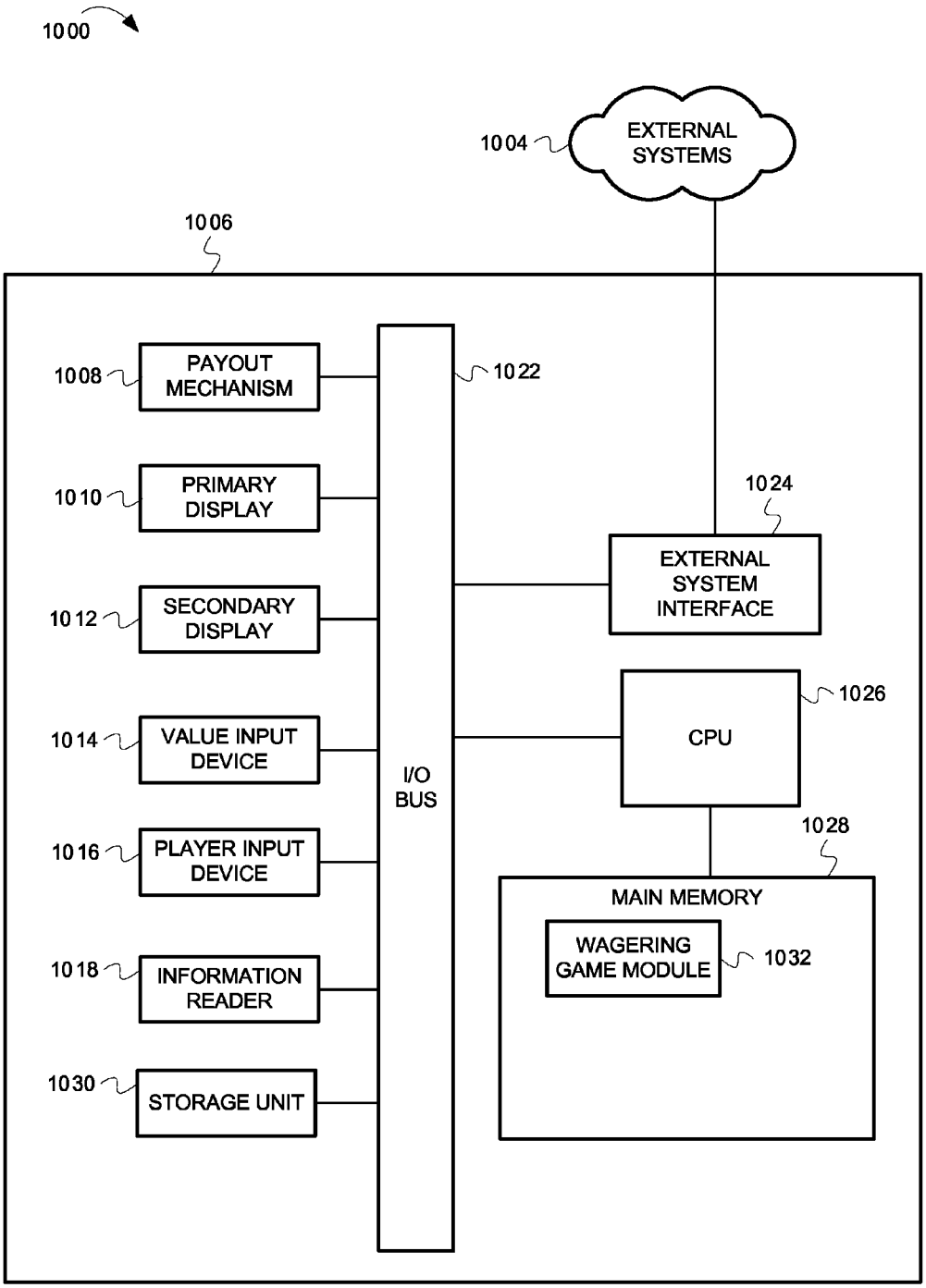
FIG. 10 is a block diagram illustrating a wagering game machine architecture, according to some example embodiments.

FIG. 1 depicts a side view of a display system having a curved beam splitter for displaying a curved floating virtual display outside a housing, according to some example embodiments. FIG. 1 depicts a display system 100 that includes a housing 101. The housing 101 houses different optical components for producing a curved aerial image 110. While shown as being external to the housing 101, in some other example embodiments, the curved aerial image 110 can be produced within the housing 101 (see example illustrated in FIG. 2 described below). The different optical components in the housing include a display device 102, a curved beam splitter 104 having a convex surface 106, and a mirror 108. Optionally, an additional optical component can include a polarizer 130. In some example embodiments, the display system 100 is part of a wagering game machine such that the display output comprises reels that represent a wagering game result. Although not shown in FIG. 1, the display device 102 can be communicatively coupled to a processor (such as a processor of a wagering game machine). This processor can execute code to control the display output of the display device 102. An example application in a wagering game machine is illustrated in FIG. 10, which is described in more detail below.

In some example embodiments, the mirror 108 is a rotationally symmetrical mirror. For example, the mirror 108 can be spherical, parabolic, etc. The mirror 108 can be composed of glass, plastic, etc. In some example embodiments, the display device 102, the curved beam splitter 104, and the mirror 108 are optically aligned such that distance from the display device 102 to the convex surface 106 of the curved beam splitter 104 plus the distance from the convex surface 106 of the curved beam splitter 104 to the mirror 108 is within a range of the focus of the mirror 108 (F) and the center of curvature of the mirror 108 (2F).

The display device 102 can be any type component that outputs an image or video. For example, the display device 102 can be a LCD panel, plasma display panel, Light Emitting Diode (LED) panel, Cathode Ray Tube (CRT), Thin Film Transistor (TFT) display, etc. The display device 102 is positioned in a fixed orientation such that the optical data (e.g., image, video, etc.) emitted there from is transmitted out along an optical path 112. In some example embodiments, a surface 103 that is outputting the optical data along the optical path 112 is coated with an anti-reflective material. The curved beam splitter 104 can be composed of glass, plastic, etc. For example, the curved beam splitter 104 can comprise a partially silvered curved glass plate. In some example embodiments, the curved beam splitter 104 is curved along its vertical axis, but is flat along its horizontal axis. The surface of the curved beam splitter 104 can comprise a small section of cylindrical shape.

The curved beam splitter 104 is optically aligned with the optical data being output from the display device 102. In some example embodiments, the display system 100 includes the polarizer 130. The polarizer 130 is positioned in a fixed orientation in a same optical alignment as the curved beam splitter 104 relative to the output from the display device 102. In this example, the polarizer 130 is positioned behind the curved beam splitter 104 in reference to the output from the display device 102. The optical path 112 is received by the convex surface 106 of the curved beam splitter 104 such that a portion of the optical data along the optical path 112 is reflected along an optical path 114 and the remaining portion of the optical data passes through the curved beam splitter 104. In this example, the polarizer 130 is curved such that it has a same or similar curvature as the curvature of the curved beam splitter 104. The polarizer 130 can also be flat. The polarizer 130 can be used to minimize reflections that may be visible to an observer of the curved aerial image 110. The polarizer 130 can be circular or linear. Alternatively or in addition, the anti-reflective film can be applied to the convex surface 106 of the curved beam splitter 104 that is receiving the optical data.

In some example embodiments, the curvature of the curved beam splitter 104 is approximately the same as the curvature of the curved aerial image 110 that is produced. In some example embodiments, the curvature of the curved beam splitter 104 is approximately ½ of the curvature of the curved aerial image 110 that is produced. In some example embodiments, the curvature of the curved beam splitter 104 is in a range of ¼ to ½ of the curvature of the curved aerial image 110 that is produced. In some example embodiments, the curvature of the curved beam splitter 104 is in a range of ½ to ¾ of the curvature of the curved aerial image 110 that is produced. In some example embodiments, the curvature of the curved beam splitter 104 is approximately ¼ of the curvature of the curved aerial image 110 that is produced. In some example embodiments, the curvature of the curved beam splitter 104 is approximately ¾ of the curvature of the curved aerial image 110 that is produced. In some example embodiments, the curvature of the curved beam splitter 104 is approximately ⅓ of the curvature of the curved aerial image 110 that is produced. In some example embodiments, the curvature of the curved beam splitter 104 is approximately ⅔ of the curvature of the curved aerial image 110 that is produced. In some example embodiments, the curvature of the curved beam splitter 104 is in a range of ⅓ to ⅔ of the curvature of the curved aerial image 110 that is produced.

The mirror 108 is in optical alignment with the curved beam splitter 104 to receive the reflected optical data there from. In particular, the optical data reflected off the convex surface 106 of the curved beam splitter 104 follows an optical path 114. This optical data is reflected off the surface of the mirror 108 along an optical path 116. This optical data along the optical path 116 forms the curved aerial image 110. In this example, the optical components (e.g., the display device 102, the curved beam splitter (and optionally the polarize 130) and the mirror 108 are positioned such that the curved aerial image is formed outside the housing 101.

Figure 2:
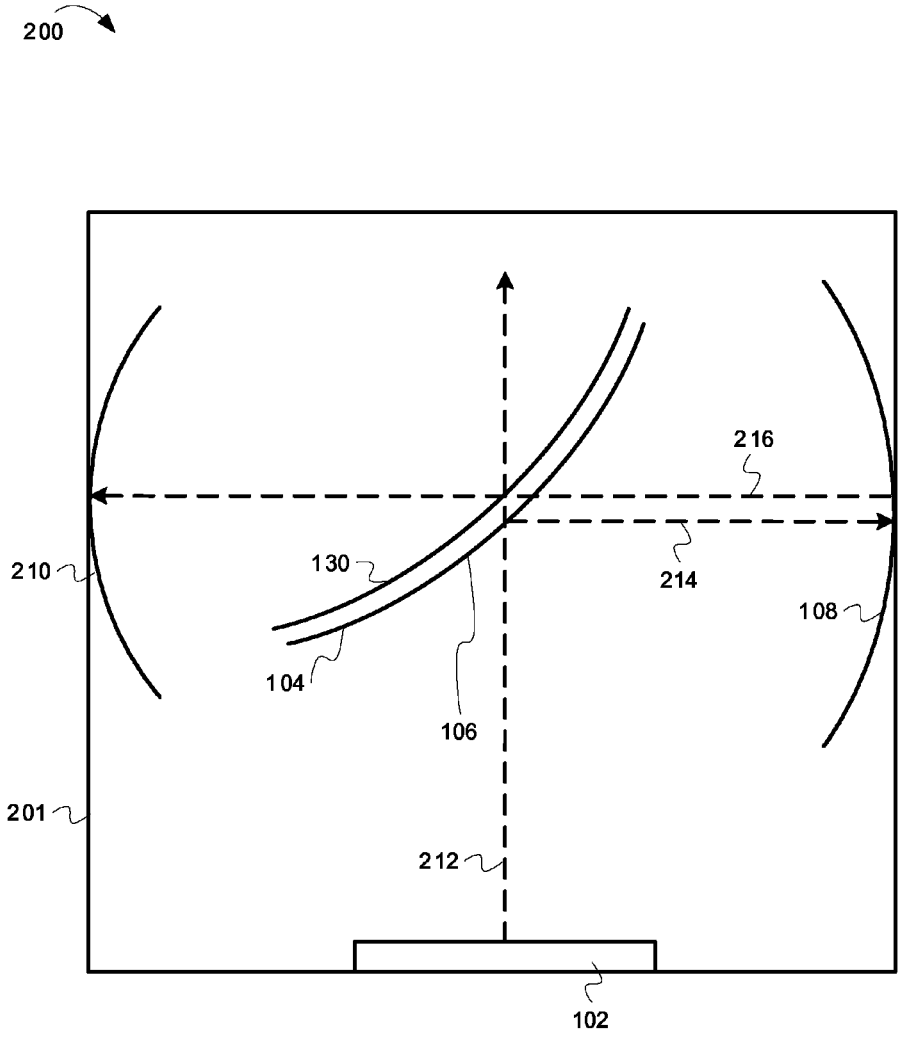
FIG. 2 depicts a side view of a display system having a curved beam splitter for displaying a curved floating virtual display within a housing, according to some example embodiments.

FIG. 2 depicts a side view of a display system having a curved beam splitter for displaying a curved floating virtual display within a housing, according to some example embodiments. In contrast to FIG. 1, a display system 200 of FIG. 2 is configured such that a curved aerial image is formed within the housing of the display system 200. In particular, FIG. 2 depicts a display system 200 that includes a housing 201. The housing 201 houses different optical components for producing a curved aerial image 210 within the housing 201.

The different optical components in the housing include the display device 102, the curved beam splitter 104 having the convex surface 106, and the mirror 108. Optionally, an additional optical component can include the polarizer 130. In this example, the display system 200 has the same optical components as the display system 100. However, the optical components are reconfigured to produce the curved aerial image 210 at a different location (within the housing 201) in comparison to the location of the curved aerial image 110. For example, the distances between the optical components, the relative positions of the optical components, the radius of the curvature of the mirror 108, etc. can be varied to vary the location of the curved aerial image 210. In some example embodiments, the display system 200 is part of a wagering game machine such that the display output comprises reels that represent a wagering game result. Although not shown in FIG. 2, the display device 102 can be communicatively coupled to a processor (such as a processor of a wagering game machine). This processor can execute code to control the display output of the display device 102. An example application in a wagering game machine is illustrated in FIG. 10, which is described in more detail below.

The curved beam splitter 104 is optically aligned with the optical data being output from the display device 102 along an optical path 212. The optical path 212 is received by the convex surface 106 of the curved beam splitter 104 such that a portion of the optical data along the optical path 212 is reflected along an optical path 214 and the remaining portion of the optical data passes through the curved beam splitter 104. In this example, the polarizer 130 is curved such that it has a same or similar curvature as the curvature of the curved beam splitter 104.

The mirror 108 is in optical alignment with the curved beam splitter 104 to receive the reflected optical data there from along the optical path 214. In particular, the optical data reflected off the convex surface 106 of the curved beam splitter 104 follows the optical path 114. This optical data is reflected off the surface of the mirror 108 along an optical path 216. This optical data along the optical path 216 forms the curved aerial image 210 within the housing 210.

Figure 3:
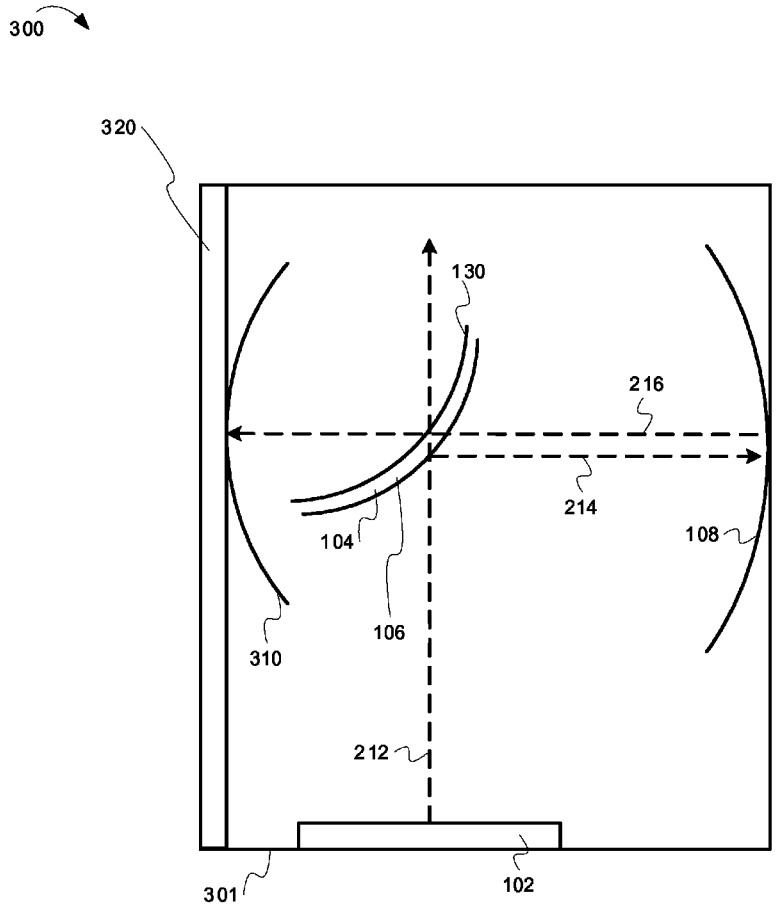
FIG. 3 depicts a side view of a display system having a curved beam splitter for displaying a curved floating virtual display within a housing and behind a transmissive display panel, according to some example embodiments.

FIG. 3 depicts a side view of a display system having a curved beam splitter for displaying a curved floating virtual display within a housing and behind a transmissive display panel, according to some example embodiments. In contrast to FIGS. 1-2, a display system 300 includes a display panel 320 wherein a curved aerial image 310 is displayed behind. In this example, the display panel 320 and the curved aerial image 310 are within a housing 301 of the display system 300. In some other example embodiments, the display panel 320 and/or the curved aerial image 310 are outside the housing 301. For example, the display panel 320 can be mounted on the outside surface of the housing 301, and the curved aerial image 310 can be produced behind the display panel 320 and internal to the housing 301. In another example, the display panel 320 can be mounted external to the housing 301 such that the curved aerial image 310 can be produced behind the display panel 320 and external to the housing 301.

The housing 301 houses different optical components for producing a curved aerial image 310 on or near the display panel 320. The different optical components in the housing include the display device 102, the curved beam splitter 104 having the convex surface 106, and the mirror 108. Optionally, an additional optical component can include the polarizer 130. In this example, the display system 300 has the same optical components as the display system 100 and the display system 200. The display system 300 has the additional display panel 320. The display panel 320 can be a LCD panel, Light Emitting Diode (LED) panel, etc. In some example embodiments, the display panel 320 is a transmissive LCD panel. The display panel 320 is transmissive such that the curved aerial image 310 can viewable through the display panel 320, while allowing the display panel 320 to produce its own viewable image. The display panel 320 may, for example, be a transmissive liquid crystal display (LCD) commercially available from LG Phillips LCD Co., Ltd., of Seoul, Korea.

The display panel 320 can be independently controlled by a controller not shown. For example, although not shown in FIG. 3, the display panel 320 can be communicatively coupled to a processor (such as a processor of a wagering game machine). With reference to the wagering game machine, the display panel 320 can be controlled by instructions executed by a processor of a wagering game machine. This processor can execute code to control the display output of the display panel 320. For example, the curved aerial image 310 can provide variable reel symbols, wherein the display panel 320 provides a foreground similar to that found in front of the traditional reels of a wagering game machine. Accordingly, two separate images are created (the curved aerial image 310 and the image output from the display panel 320) to form a transmissive reel presentation.

Although not shown in FIG. 3, the display device 102 can be communicatively coupled to a processor (such as a processor of a wagering game machine). This processor can execute code to control the display output of the display device 102. An example application in a wagering game machine is illustrated in FIG. 10, which is described in more detail below.

The curved beam splitter 104 is optically aligned with the optical data being output from the display device 102 along an optical path 212. The optical data along the optical path 212 is received by the convex surface 106 of the curved beam splitter 104 such that a portion of the optical data along the optical path 212 is reflected along an optical path 214 and the remaining portion of the optical data passes through the curved beam splitter 104. In this example, the polarizer 130 is curved such that it has a same or similar curvature as the curvature of the curved beam splitter 104.

The mirror 108 is in optical alignment with the curved beam splitter 104 to receive the reflected optical data there from along the optical path 214. In particular, the optical data reflected off the convex surface 106 of the curved beam splitter 104 follows the optical path 114. This optical data is reflected off the surface of the mirror 108 along an optical path 216. This optical data along the optical path 216 passes through the display panel 320 and forms the curved aerial image 210 within the housing 210 and in front of an outward facing surface of the display panel 320.

Figure 4:
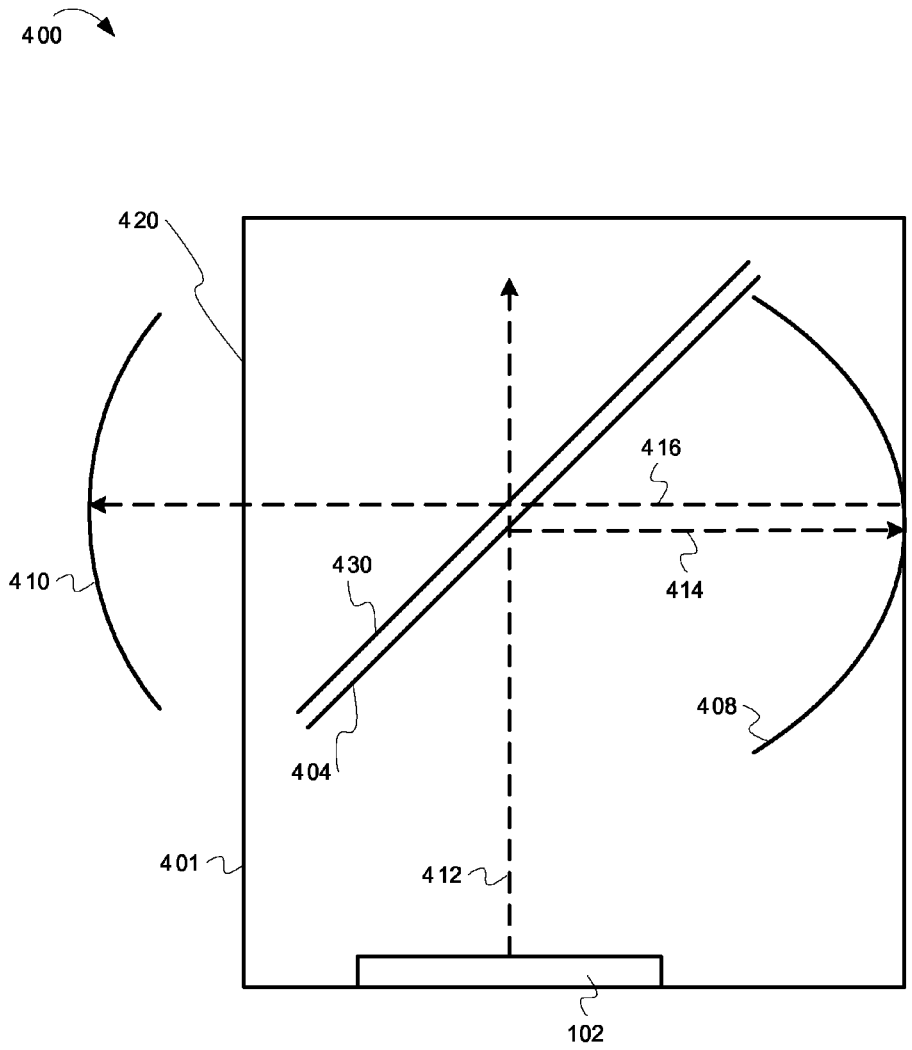
FIG. 4 depicts a side view of a display system having an altered rotationally symmetrical mirror for displaying a curved floating virtual display outside a housing, according to some example embodiments.

FIG. 4 depicts a side view of a display system having an altered rotationally symmetrical mirror for displaying a curved floating virtual display outside a housing, according to some example embodiments. In contrast to FIGS. 1-3, a display system 400 of FIG. 4 provides a curved aerial image by modifying the curvature of the rotationally symmetrical mirror. Also in this example, the beam splitter is not curved. FIG. 4 depicts the display system 400 that includes a housing 401. The housing 401 houses different optical components for producing a curved aerial image 410 outside the housing 401. Alternatively, the different optical components can be configured such that the curved aerial image is produced within the housing 401.

The different optical components in the housing include the display device 102, a beam splitter 404 and the mirror 408. Optionally, an additional optical component can include the polarizer 430. In this example, the display system 400 includes the beam splitter 404 that is unlike the curved beam splitter 104 in FIGS. 1-3 because the beam splitter 404 is not curved to provide a curved aerial image. Also in this example, the display system 400 includes a mirror 408 that is unlike the mirror 108 in FIGS. 1-3 because the mirror 408 has a different curvature along its vertical and horizontal axes that causes the aerial image to be curved. Accordingly in this example, the curvature of the aerial image (the curved aerial image 410) is the result of the different curvature of the mirror 408—and not the of a beam splitter that has been curved.

In some example embodiments, the display system 400 is part of a wagering game machine such that the display output comprises reels that represent a wagering game result. Although not shown in FIG. 4, the display device 102 can be communicatively coupled to a processor (such as a processor of a wagering game machine). This processor can execute code to control the display output of the display device 102. An example application in a wagering game machine is illustrated in FIG. 10, which is described in more detail below.

The beam splitter 404 is optically aligned with the optical data being output from the display device 102 along an optical path 412. The optical path 412 is received by the beam splitter 404 such that a portion of the optical data along the optical path 412 is reflected along an optical path 414 and the remaining portion of the optical data passes through the beam splitter 404. The mirror 408 is in optical alignment with the beam splitter 404 to receive the reflected optical data there from along the optical path 414. This optical data is reflected off the surface of the mirror 408 along an optical path 416. This optical data along the optical path 416 forms the curved aerial image 410 outside the housing 401. In this example, the modified curvature of the mirror 408 causes the curved aerial image 410 to be curved.

In some example embodiments, the display system 400 can also include a display panel (similar to the display panel 320 of FIG. 3). Therefore, the curved aerial image 410 and/or a display panel can be within or outside the housing 401 (as described in reference to FIG. 3 above). For example, the display panel can be mounted on the outside surface of the housing 401, and the curved aerial image 410 can be produced on or near an outward facing surface of the display panel. In another example, the display panel can be mounted within the housing 401, and the curved aerial image 410 can be produced, external to the housing 401, on or near an outward facing surface of the display panel. As described above, this change of location of the curved aerial image 410 can be created based on a reconfiguration of the optical components. For example, the distances between the optical components, the relative positions of the optical components, the radius of the curvature of the mirror 108, etc. can be varied to vary the location of the curved aerial image 410.

Figure 5:
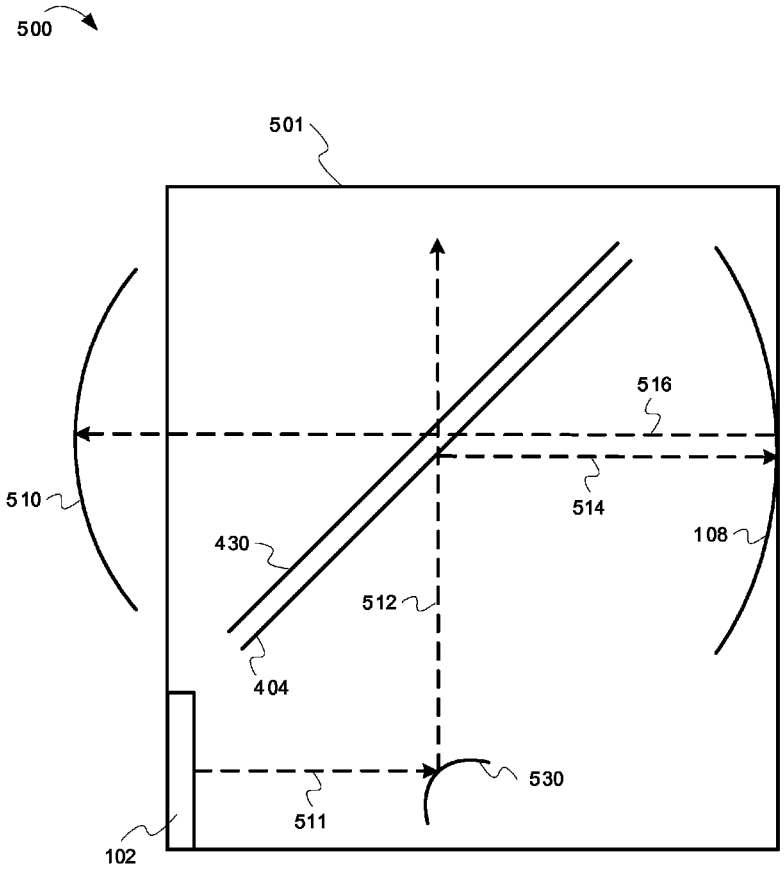
FIG. 5 depicts a side view of a display system having an additional curved mirror in an optical path for displaying a curved floating virtual display outside a housing, according to some example embodiments.

FIG. 5 depicts a side view of a display system having an additional curved mirror in an optical path for displaying a curved floating virtual display outside a housing, according to some example embodiments. In contrast to FIGS. 1-4, a display system 500 of FIG. 5 provides a curved aerial image by adding an additional curved mirror in the optical path between the display device 102 and the beam splitter 406. Also in contrast to FIGS. 1-4, the display system 500 is configured such that the display device 102 is repositioned such that its output image is reflected off this additional curved mirror. In this example, the display device 500 is rotated 90° such that the display device 102 is located against a vertical wall of a housing 501 (instead of a horizontal wall). In this example, the display device 500 is along the left vertical wall of the housing 501. In this example similar to the display system 400 of FIG. 4, the beam splitter is not curved. FIG. 5 depicts the display system 500 that includes a housing 501. The housing 501 houses different optical components for producing a curved aerial image 510 outside the housing 501. Alternatively, the different optical components can be configured such that the curved aerial image is produced within the housing 501.

The different optical components in the housing include the display device 102, the beam splitter 404 and a mirror 108. Optionally, an additional optical component can include the polarizer 430. In this example, the display system 500 includes the beam splitter 404 that is unlike the curved beam splitter 104 in FIGS. 1-3 because the beam splitter 404 is not curved to provide a curved aerial image. Also in this example, a mirror 530 has been added along an optical path 511 between the display device 102 and the beam splitter 404. The geometry of the mirror 530 relative to the display device 102 is configured such that the mirror 530 reflects the optical path 511 along an optical path 512 toward the beam splitter 404. As shown, the mirror 530 is configured such that its convex surface receives the optical path 511 and reflects the optical path 512. In some example embodiments, the mirror 530 is positioned 45° relative to the optical path 511 of the image from the surface of the display device 102. Accordingly in this example, the curvature of the aerial image (the curved aerial image 510) is the result of the adding of the mirror 530 in the optical path 512—and not the result of a beam splitter that has been curved (see FIGS. 1-3) or the mirror 408 having an altered curvature (see FIG. 4).

In some example embodiments, the mirror 530 can be composed of glass, plastic, etc. In some example embodiments, the curvature of the mirror 530 is approximately the same as the curvature of the curved aerial image 510 that is produced. In some example embodiments, the curvature of the mirror 530 is approximately ½ of the curvature of the curved aerial image 510 that is produced. In some example embodiments, the curvature of the mirror 530 is in a range of ¼ to ½ of the curvature of the curved aerial image 510 that is produced. In some example embodiments, the curvature of the mirror 530 is in a range of ½ to ¾ of the curvature of the curved aerial image 510 that is produced. In some example embodiments, the curvature of the mirror 530 is approximately ¼ of the curvature of the curved aerial image 510 that is produced. In some example embodiments, the curvature of the mirror 530 is approximately ¾ of the curvature of the curved aerial image 510 that is produced. In some example embodiments, the curvature of the mirror 530 is approximately ⅓ of the curvature of the curved aerial image 510 that is produced. In some example embodiments, the curvature of the mirror 530 is approximately ⅔ of the curvature of the curved aerial image 510 that is produced. In some example embodiments, the curvature of the mirror 530 is in a range of ⅓ to ⅔ of the curvature of the curved aerial image 510 that is produced.

In some example embodiments, the display system 500 is part of a wagering game machine such that the display output comprises reels that represent a wagering game result. Although not shown in FIG. 5, the display device 102 can be communicatively coupled to a processor (such as a processor of a wagering game machine). This processor can execute code to control the display output of the display device 102. An example application in a wagering game machine is illustrated in FIG. 10, which is described in more detail below.

The beam splitter 404 is optically aligned with the optical data being output from the display device 102 along an optical path 512. In the optical path 512 between the beam splitter 404 and the display device 102, the mirror 530 is optically aligned with the optical data being output from the display device 102. The mirror 530 is at least partially transmissive such that at least a portion of the optical data passes along the optical path to the beam splitter 404. Also, a curvature of the mirror 530 is such that the aerial image produced is curved.

The optical data along the optical path 511 that is reflected off the mirror 530 is transmitted along the optical path 512 and received by the beam splitter 404. The mirror 108 is in optical alignment with the beam splitter 404 to receive the reflected optical data there from along the optical path 514. This optical data is reflected off the surface of the mirror 108 along an optical path 516. This optical data along the optical path 516 forms the curved aerial image 510 outside the housing 501. In this example, the curvature of the mirror 530 causes the curved aerial image 510 to be curved.

In some example embodiments, the display system 500 can also include a display panel (similar to the display panel 320 of FIG. 3). Therefore, the curved aerial image 510 and/or a display panel can be within or outside the housing 501 (as described in reference to FIG. 3 above). For example, the display panel can be mounted on the outside surface of the housing 501, and the curved aerial image 510 can be produced on or near an outward facing surface of the display panel. In another example, the display panel can be mounted within the housing 501, and the curved aerial image 510 can be produced, external to the housing 501, on or near an outward facing surface of the display panel. As described above, this change of location of the curved aerial image 510 can be created based on a reconfiguration of the optical components. For example, the distances between the optical components, the relative positions of the optical components, the radius of the curvature of the mirror 108, etc. can be varied to vary the location of the curved aerial image 510.

Figure 6:
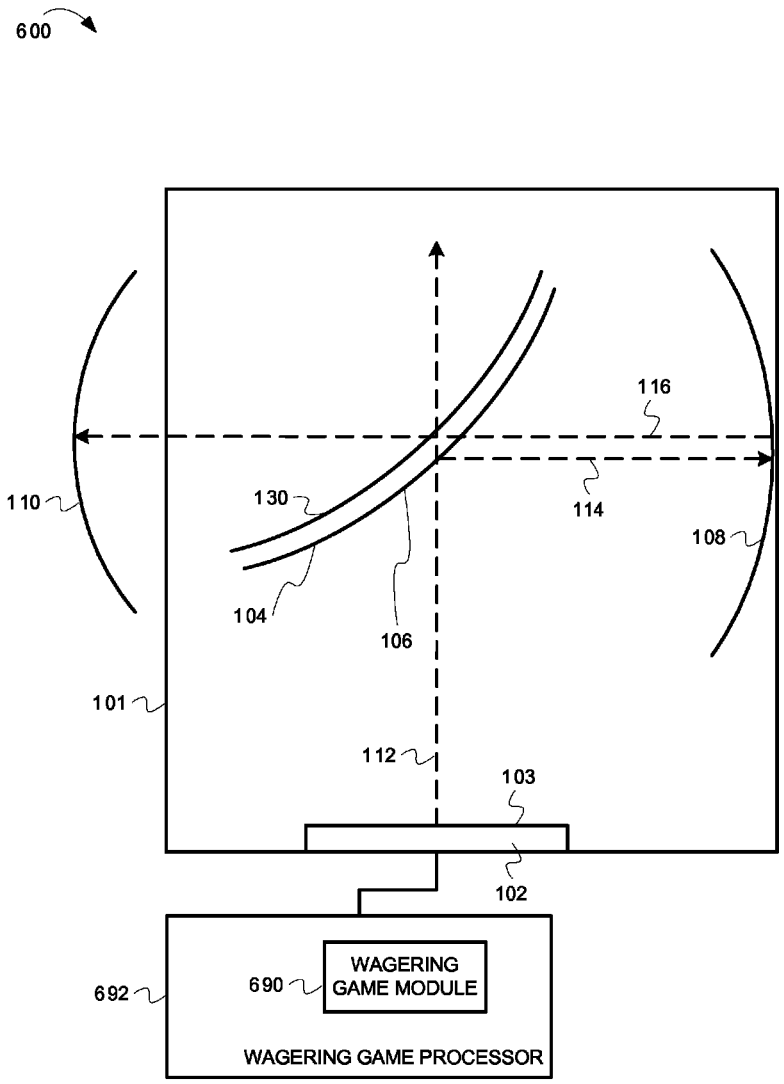
FIG. 6 depicts a side view of a display system having a curved beam splitter for displaying a curved floating virtual display outside a housing for a wagering game machine, according to some example embodiments.

FIG. 6 depicts a side view of a display system having a curved beam splitter for displaying a curved floating virtual display outside a housing for a wagering game machine, according to some example embodiments. FIG. 6 depicts a display system 600 that includes the housing 101. The display system 600 is similar to the display system 100 of FIG. 1. However, the display system 600 is specific for operations in a wagering game machine. In contrast to FIG. 1, the display system 600 is configured such that the display device 102 is communicatively coupled to a wagering game processor 692 that is executing a wagering game module 690. The execution of the wagering game module 690 by the wagering game processor 692 causes instructions to be transmitted to the display device 102 regarding the images to be displayed. In this example, the wagering game processor 692 would transmit instructions to display video reels spinning or stopped that provide a result of a wagering game machine. As described above in reference to FIG. 1, the optical components in the housing 101 produce the curved aerial image 110.

While shown as being external to the housing 101, in some other example embodiments, the curved aerial image 110 can be produced within the housing 101 (see example illustrated in FIG. 2). The different optical components in the housing include the display device 102, the curved beam splitter 104 having the convex surface 106, and the mirror 108. Optionally, an additional optical component can include the polarizer 130.

In some example embodiments, the mirror 108 is a rotationally symmetrical mirror. For example, the mirror 108 can be spherical, parabolic, etc. The mirror 108 can be composed of glass, plastic, etc. In some example embodiments, the display device 102, the curved beam splitter 104, and the mirror 108 are optically aligned such that distance from the display device 102 to the convex surface 106 of the curved beam splitter 104 plus the distance from the convex surface 106 of the curved beam splitter 104 to the mirror 108 is within a range of the focus of the mirror 108 (F) and the center of curvature of the mirror 108 (2F).

The display device 102 is positioned in a fixed orientation such that the optical data (e.g., image, video, etc.) emitted there from is transmitted out along an optical path 112. The curved beam splitter 104 is optically aligned with the optical data being output from the display device 102. In some example embodiments, the display system 100 includes the polarizer 130. The polarizer 130 is positioned in a fixed orientation in a same optical alignment as the curved beam splitter 104 relative to the output from the display device 102. In this example, the polarizer 130 is positioned behind the curved beam splitter 104 in reference to the output from the display device 102. The optical path 112 is received by the convex surface 106 of the curved beam splitter 104 such that a portion of the optical data along the optical path 112 is reflected along an optical path 114 and the remaining portion of the optical data passes through the curved beam splitter 104. In this example, the polarizer 130 is curved such that it has a same or similar curvature as the curvature of the curved beam splitter 104. The polarizer 130 can also be flat. The polarizer 130 can be used to minimize reflections that may be visible to an observer of the curved aerial image 110. The polarizer 130 can be circular or linear. Alternatively or in addition, the anti-reflective film can be applied to the convex surface 106 of the curved beam splitter 104 that is receiving the optical data.

The mirror 108 is in optical alignment with the curved beam splitter 104 to receive the reflected optical data there from. In particular, the optical data reflected off the convex surface 106 of the curved beam splitter 104 follows an optical path 114. This optical data is reflected off the surface of the mirror 108 along an optical path 116. This optical data along the optical path 116 forms the curved aerial image 110. In this example, the optical components (e.g., the display device 102, the curved beam splitter (and optionally the polarize 130) and the mirror 108 are positioned such that the curved aerial image is formed outside the housing 101.

Figure 7:
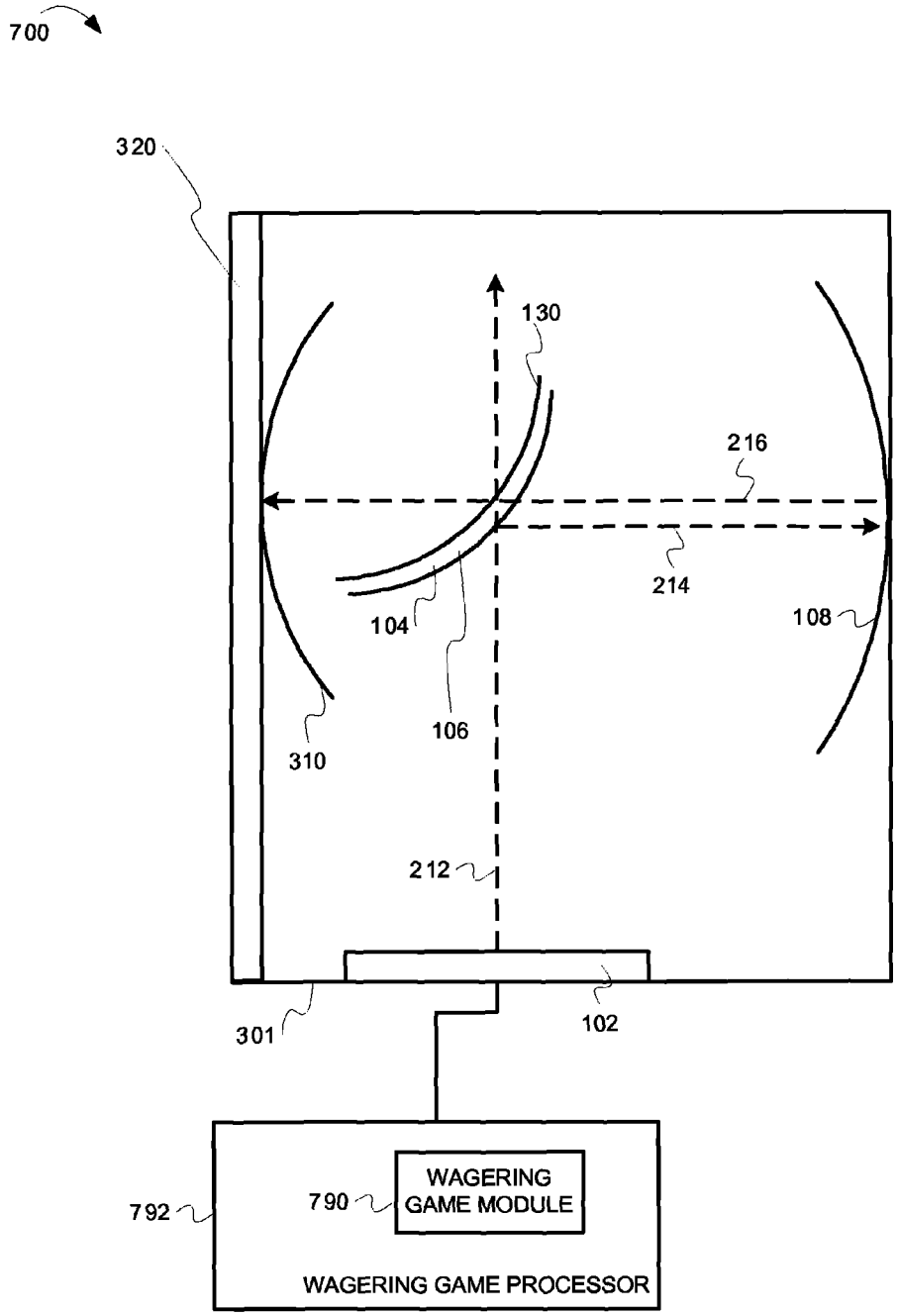
FIG. 7 depicts a side view of a display system having a curved beam splitter for displaying a curved floating virtual display within a housing and behind a transmissive display panel for a wagering game machine, according to some example embodiments.
Figure 8:
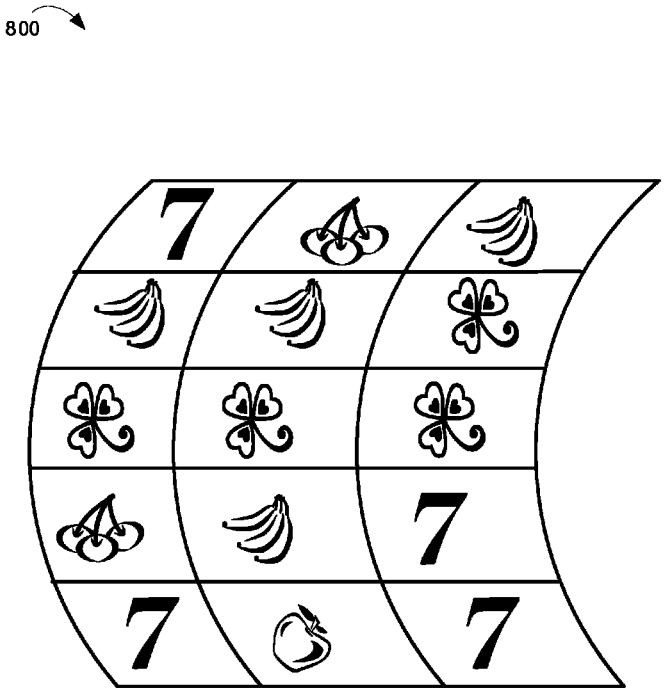
FIG. 8 depicts an example of a curved aerial image of reels for a wagering game machine, according to some example embodiments.

FIG. 7 depicts a side view of a display system having a curved beam splitter for displaying a curved floating virtual display within a housing and behind a transmissive display panel for a wagering game machine, according to some example embodiments. FIG. 7 depicts a display system 700 that includes the housing 301. The display system 700 is similar to the display system 300 of FIG. 3. However, the display system 700 is specific for operations in a wagering game machine. In contrast to FIG. 3, the display system 700 is configured such that the display device 102 is communicatively coupled to a wagering game processor 792 that is executing a wagering game module 790. The execution of the wagering game module 790 by the wagering game processor 792 causes instructions to be transmitted to the display device 102 regarding the images to be displayed. In this example, the wagering game processor 792 would transmit instructions to display video reels spinning or stopped that provide a result of a wagering game machine. As described above in reference to FIG. 3, the optical components in the housing 301 produce the curved aerial image 310.

In this example, the display panel 320 and the curved aerial image 310 are within a housing 301 of the display system 300. In some other example embodiments, the display panel 320 and/or the curved aerial image 310 are outside the housing 301. For example, the display panel 320 can be mounted on the outside surface of the housing 301, and the curved aerial image 310 can be produced behind the display panel 320 and internal to the housing 301. In another example, the display panel 320 can be mounted external to the housing 301 such that the curved aerial image 310 can be produced behind the display panel 320 and external to the housing 301.

The housing 301 houses different optical components for producing a curved aerial image 310 on or near the display panel 320. The different optical components in the housing include the display device 102, the curved beam splitter 104 having the convex surface 106, and the mirror 108. Optionally, an additional optical component can include the polarizer 130. The display system 700 has the additional display panel 320. The display panel 720 can be a LCD panel, Light Emitting Diode (LED) panel, etc. In some example embodiments, the display panel 320 is a transmissive LCD panel. The display panel 320 is transmissive such that the curved aerial image 310 can viewable through the display panel 320, while allowing the display panel 320 to produce its own viewable image. The display panel 320 may, for example, be a transmissive liquid crystal display (LCD) commercially available from LG Phillips LCD Co., Ltd., of Seoul, Korea. The display panel 320 can be communicatively coupled to the wagering game processor 792 such that execution of the wagering game module 790 controls the display output of the display panel 320. Alternatively, the display panel 320 can be independently controlled by a controller not shown. The curved aerial image 310 can provide variable reel symbols, wherein the display panel 320 provides a foreground similar to that found in front of the traditional reels of a wagering game machine. Accordingly, two separate images are created (the curved aerial image 310 and the image output from the display panel 320) to form a transmissive reel presentation.

The curved beam splitter 104 is optically aligned with the optical data being output from the display device 102 along the optical path 212. The optical data along the optical path 212 is received by the convex surface 106 of the curved beam splitter 104 such that a portion of the optical data along the optical path 212 is reflected along an optical path 214 and the remaining portion of the optical data passes through the curved beam splitter 104. In this example, the polarizer 130 is curved such that it has a same or similar curvature as the curvature of the curved beam splitter 104.

The mirror 108 is in optical alignment with the curved beam splitter 104 to receive the reflected optical data there from along the optical path 214. In particular, the optical data reflected off the convex surface 106 of the curved beam splitter 104 follows the optical path 114. This optical data is reflected off the surface of the mirror 108 along an optical path 216. This optical data along the optical path 216 passes through the display panel 320 and forms the curved aerial image 210 within the housing 210 and in front of an outward facing surface of the display panel 320.

FIGS. 1-7 depict display systems having different optical components having curvatures that produced a curved aerial image. In some example embodiments, multiple optical components that produce the curved aerial image can be combined into a same display system. For example, instead of a single additional curved mirror along the optical path (as depicted in FIGS. 5-7), a display system can include multiple additional curve mirrors along the optical path. In another example, a display system can include both a curved beam splitter (from FIG. 1) and an additional curved mirror (from FIGS. 5-7) to form the curved aerial image. In this example, the curvature of the curved beam splitter would be one-fourth the curvature of the curved aerial image, and the curvature of the additional curved mirror would be one-fourth the curvature of the curved aerial image. In another example, a display system can include both a curved beam splitter (from FIG. 1) and a mirror having an altered curvature (from FIG. 4) to form the curved aerial image.

FIG. 8 depicts an example of a curved aerial image of reels for a wagering game machine, according to some example embodiments. In particular, FIG. 8 depicts a curved aerial image 800 of three reels that display the wagering game result from a wagering game machine. The curved aerial image 800 can include a video of the reels spinning, the reels in a stopped position showing the wagering game result, etc. The curvature of the curved aerial image 800 is determined by the curvature of the optical components that are used to produce the curved aerial image as described above. The image of the reels would be flat as seen on the face of the display device 102.

Example Operations

This section describes operations associated with some example embodiments. In the discussion below, the flowchart will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in the flowchart.

Figure 9:
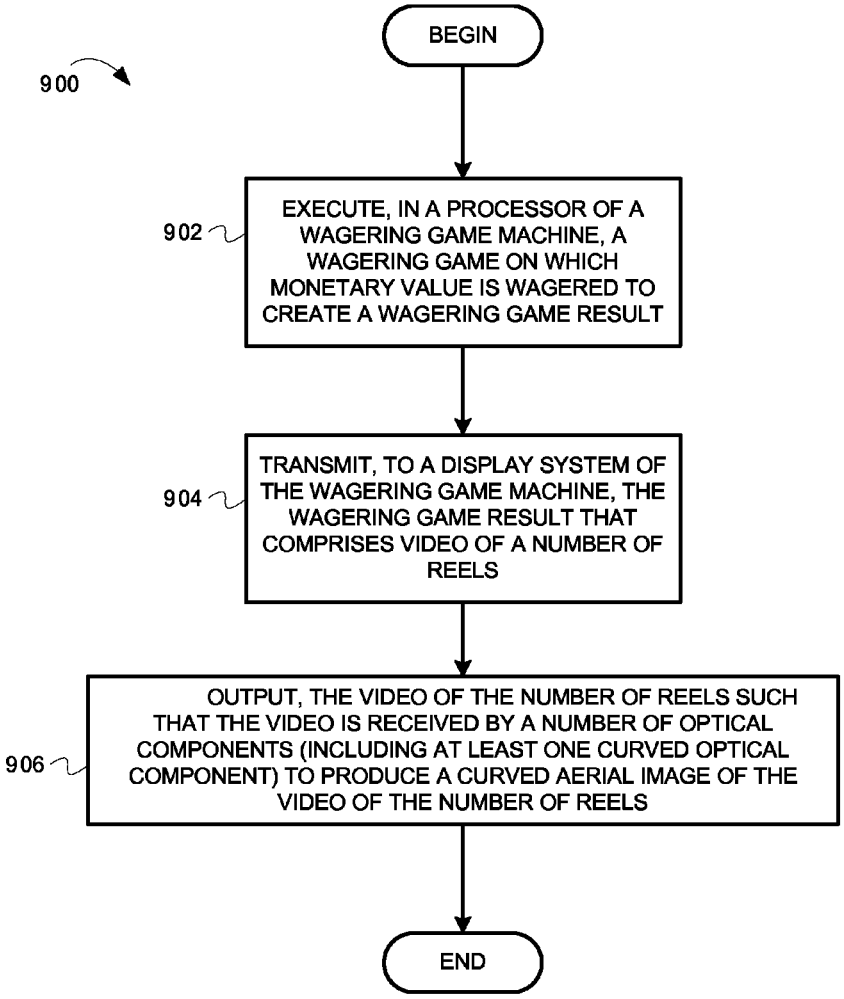
FIG. 9 depicts a flowchart for displaying a curved floating virtual display, according to some example embodiments.

FIG. 9 depicts a flowchart for displaying a curved floating virtual display, according to some example embodiments. In this example, operations of a flowchart 900 are performed by components of a wagering game machine to produce a curved aerial image of video of reels that provide a wagering game result. The operations of the flowchart 900 begin at block 902.

At block 902, a wagering game module executing on a processor of a wagering game machine executes a wagering game on which monetary value is wagered to create a wagering game result. An example of a wagering game module that can perform these operations is illustrated in FIG. 10 (described below). As described above, such a processor of a wagering game machine can be communicatively coupled to any of the display systems described above. The operations of the flowchart continue at block 904.

At block 904, the wagering game module executing on the processor of the wagering game machine transmits, to a display system of the wagering game machine, the wagering game result that comprises video of a number of reels. As described above, such a processor of a wagering game machine can be communicatively coupled to any of the display systems described above. The operations of the flowchart 900 continue at block 906.

At block 906, the display system of the wagering game machine outputs the video of the number of reels such that the video is received by a number of optical components (including at least one curved optical component) to produce a curved aerial image of the video of the number of reels. As described above, the display systems in any of FIGS. 1-7 can produce a curved aerial image based on at least one curved optical component. Although not shown in FIG. 9, the operations of the flowchart 900 can also include the transmission of a display output to a transmissive display panel that is part of the display system (see description of FIG. 3 above). In response, the transmissive display panel can produce an image that behind the curved aerial image. For example, the curved aerial image can provide variable reel symbols, wherein the transmissive display panel provides a background of traditional reels of a wagering game machine. Accordingly, two separate images are created (the curved aerial image and the image output from the transmissive display panel) to form a transmissive reel presentation. The operations of the flowchart 900 are complete.

Operating Environment

This section describes an example operating environment and presents structural aspects of some embodiments. This section includes discussion about a wagering game machine architecture that can include one or more of the display systems described above.

Wagering Game Machine Architecture

FIG. 10 is a block diagram illustrating a wagering game machine architecture, according to some example embodiments. As shown in FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game module 1032. In one embodiment, the wagering game module 1032 can present wagering games, such as video poker, video black jack, video slots, video lottery, etc., in whole or part. In some example embodiments, the wagering game module 1032 can control the display devices and transmissive display panels in the display systems described above.

The CPU 1026 is also connected to an input/output (I/O) bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems 1004 (e.g., wagering game networks). The primary display 1010 and/or the secondary display 1012 can be at least one of the display systems described above.

In one embodiment, the wagering game machine 1006 can include additional peripheral devices and/or more than one of each component shown in FIG. 10. For example, in one embodiment, the wagering game machine 1006 can include multiple external system interfaces 1024 and/or multiple CPUs 1026. In one embodiment, any of the components can be integrated or subdivided.

Any component of the architecture 1000 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Wagering Game Machine

Figure 11:
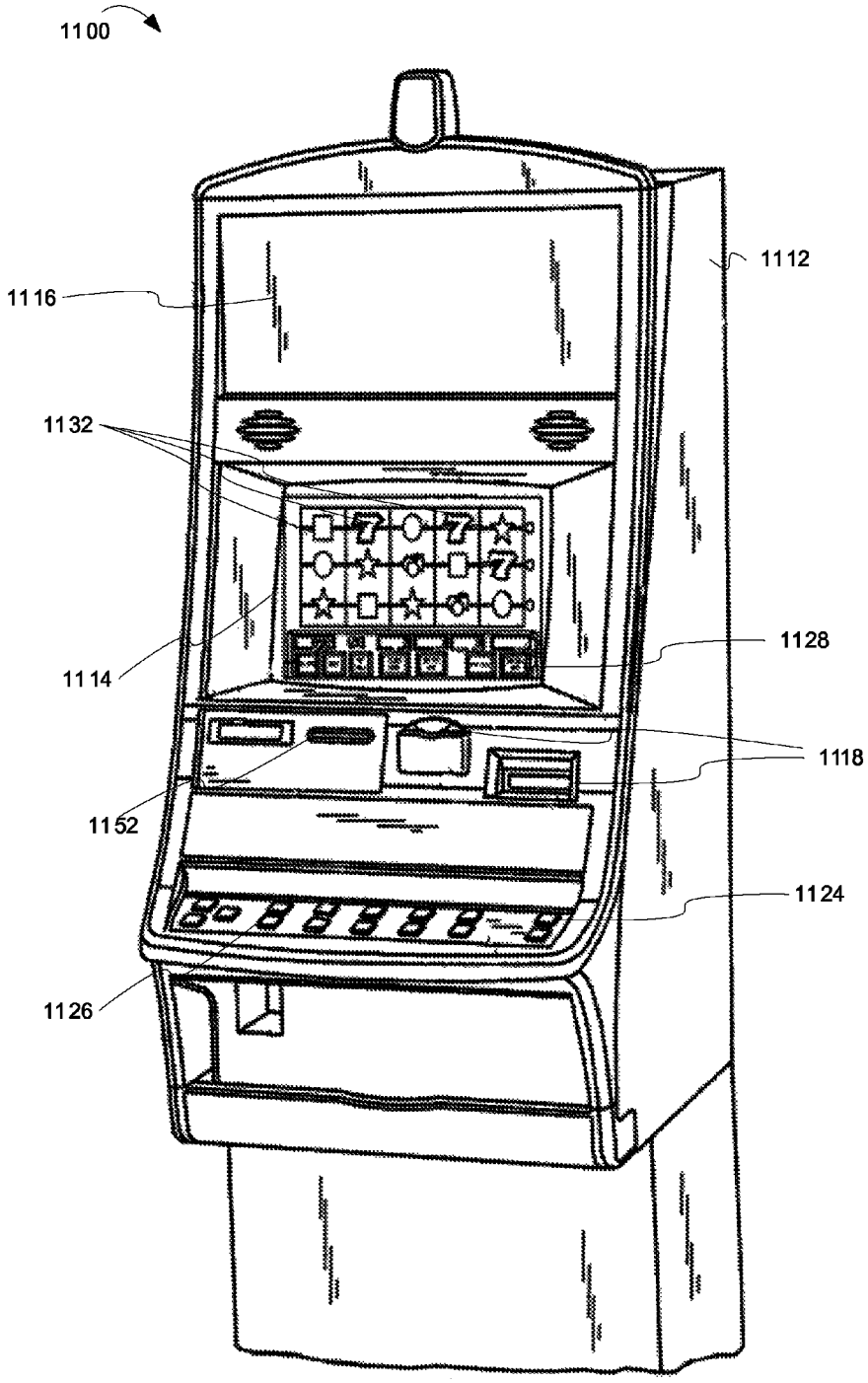
FIG. 11 is a perspective view of a wagering game machine, according to some example embodiments.

FIG. 11 is a perspective view of a wagering game machine, according to some example embodiments. Referring to FIG. 11, a wagering game machine 1100 is used in gaming establishments, such as casinos. According to embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100. The primary display 1114 and/or the secondary display 1116 can be at least one of the display systems described above.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bartop model, mobile handheld model, or workstation console model.

A player begins playing a basic wagering game by making a wager via the value input device 1118. The player can initiate play by using the player input device's buttons or touch screen 1128. The basic game can include arranging a plurality of symbols along a payline 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A wagering game machine comprising:

a processor;

a wagering game module, executable on the processor, configured to present a wagering game on which monetary value can be wagered to a wagering game player;

a video device communicatively coupled to the processor, wherein the video device is configured to output a video image of reels as part of an output of the wagering game;

a curved beam splitter positioned in optical alignment with the video device, wherein a convex surface of the curved beam splitter is configured to receive the video image being output from the video device, wherein a part of the video image is to reflect of the convex surface of the curved beam splitter; and a rotationally symmetrical mirror positioned in optical alignment with the curved beam splitter such that the part of the video image reflected off the convex surface of the curved beam splitter is to reflect off the rotationally symmetrical mirror to produce a curved aerial image.

2. The wagering game machine of claim 1, further comprising a display panel positioned in optical alignment with the rotationally symmetrical mirror such that the curved aerial image passes through the display panel and is produced on a surface of the display panel.

3. The wagering game machine of claim 1, wherein the curved aerial image is formed internal to the wagering game machine.

4. The wagering game machine of claim 1, wherein the curved aerial image comprises a three-dimensional image.

5. The wagering game machine of claim 1, wherein a curvature of the curved beam splitter is equal to a curvature of the curved aerial image.

6. A method comprising:

executing, in a processor of a wagering game machine, a wagering game on which monetary value is wagered to create a wagering game result;

transmitting, to a video device of the wagering game machine, the wagering game result that comprises video of a number of reels; and outputting the video of the number of reels such that the video is received by a convex surface of a curved beam splitter, wherein a partial reflection of the video of the number of reels from the curved beam splitter is directed to a surface of a rotationally symmetrical mirror, wherein the partial reflection of the video of the number of reels is reflected off the rotationally symmetrical mirror to output a curved aerial image of the video of the number of reels.

7. The method of claim 6, wherein outputting the video of the number of reels comprises outputting the video of the number of reels through a display panel such that the curved aerial image is produced on a surface of the display panel.

8. The method of claim 6, wherein the curved aerial image is formed internal to the wagering game machine.

9. The method of claim 6, wherein the curved aerial image comprises a three-dimensional image.

10. The method of claim 6, wherein a curvature of the curved beam splitter is equal to a curvature of the curved aerial image.

11. An apparatus comprising:

means for executing, in a processor of a wagering game machine, a wagering game on which monetary value is wagered to create a wagering game result;

means for transmitting, to a video device of the wagering game machine, the wagering game result that comprises video of a number of reels; and means for outputting the video of the number of reels such that the video is received by a convex surface of a curved beam splitter, wherein a partial reflection of the video of the number of reels from the curved beam splitter is directed to a surface of a rotationally symmetrical mirror, wherein the partial reflection of the video of the number of reels is reflected off the rotationally symmetrical mirror to output a curved aerial image of the video of the number of reels.

12. The apparatus of claim 11, wherein means for outputting the video of the number of reels comprises means for outputting the video of the number of reels through a display panel such that the curved aerial image is produced on a surface of the display panel.

13. The apparatus of claim 11, wherein a curvature of the curved beam splitter is one-half a curvature of the curved aerial image.

14. A wagering game machine comprising:

a processor;

a wagering game module, executable on the processor, configured to present a wagering game on which monetary value can be wagered to a wagering game player;

a video device communicatively coupled to the processor, wherein the video device is configured to output a video image of reels as part of an output of the wagering game;

a beam splitter positioned in optical alignment with the video device;

a rotationally symmetrical mirror positioned in optical alignment with the beam splitter such that a part of the video image that is reflected off the beam splitter is directed to the rotationally symmetrical mirror, wherein the part of the video image reflected off the rotationally symmetrical mirror produces a curved aerial image; and at least one of a first curved mirror positioned in the optical alignment between the video device and the beam splitter, a second curved mirror positioned in the optical alignment between the beam splitter and the rotationally symmetrical mirror, and a third curved mirror positioned between the rotationally symmetrical mirror and a location where the curved aerial image is produced.

15. The wagering game machine of claim 14, further comprising a display panel positioned in optical alignment with the rotationally symmetrical mirror such that the curved aerial image passes through the display panel and is produced on a surface of the display panel.

16. The wagering game machine of claim 14, wherein the curved aerial image is formed internal to the wagering game machine.

17. The wagering game machine of claim 14, wherein the curved aerial image comprises a three-dimensional image.

18. The wagering game machine of claim 14, wherein a curvature of the first curved mirror, a curvature of the second curved mirror, and a curvature of the third curved mirror is one-half a curvature of the curved aerial image.

19. The wagering game machine of claim 1, wherein a surface of the display of the video device from which the video image is output comprises a flat surface.

20. The method of claim 6, wherein a surface of the display of the video device from which the video is output comprises a flat surface.

21. The apparatus of claim 11, wherein a surface of the display of the video device from which the video is output comprises a flat surface.

22. The wagering game machine of claim 14, wherein a surface of the display of the video device from which the video image is output comprises a flat surface.

* * * * *